US011147307B2

(12) United States Patent
Lavanant et al.

(10) Patent No.: US 11,147,307 B2
(45) Date of Patent: Oct. 19, 2021

(54) FLAVOR CAPSULES FOR SMOKING ARTICLES

(71) Applicant: PHILIP MORRIS PRODUCTS S.A., Neuchatel (CH)

(72) Inventors: Laurent Lavanant, Evian-les-Bains (FR); Yves Jordil, Lausanne (CH)

(73) Assignee: Philip Morris Products S.A., Neuchatel (CH)

( * ) Notice: Subject to any disclaimer, the term of this patent is extended or adjusted under 35 U.S.C. 154(b) by 314 days.

(21) Appl. No.: 15/752,405

(22) PCT Filed: Aug. 11, 2016

(86) PCT No.: PCT/IB2016/054844

§ 371 (c)(1),
(2) Date: Feb. 13, 2018

(87) PCT Pub. No.: WO2017/025924

PCT Pub. Date: Feb. 16, 2017

(65) Prior Publication Data

US 2019/0000135 A1 Jan. 3, 2019

(30) Foreign Application Priority Data

Aug. 13, 2015 (EP) ..... 15181009

(51) Int. Cl.
*A24D 3/06* (2006.01)
*A24D 3/14* (2006.01)
(Continued)

(52) U.S. Cl.
CPC ..... *A24D 3/061* (2013.01); *A24B 15/303* (2013.01); *A24B 15/40* (2013.01); *A24D 3/0216* (2013.01); *A24D 3/14* (2013.01)

(58) Field of Classification Search
CPC ..... A24D 3/061; A24B 15/303
(Continued)

(56) References Cited

U.S. PATENT DOCUMENTS 4,582,702 A * 4/1986 Grollier ..... A61K 8/39 424/52
6,695,924 B1 * 2/2004 Dube ..... A24B 15/306 127/DIG. 1
(Continued)

FOREIGN PATENT DOCUMENTS

CN 101203148 A 6/2008
CN 103141939 A 6/2013
(Continued)

OTHER PUBLICATIONS

An Overview of MCT Oil and Medium Chain Triglycerides, Acme-Hardesty Company, https://www.acme-hardesty.com/overview-mct-oil-medium-chain-triglycerides (Year: 2019).*
(Continued)

*Primary Examiner* — Eric Yaary
*Assistant Examiner* — Russell E Sparks
(74) *Attorney, Agent, or Firm* — Mueting Raasch Group

(57) ABSTRACT

A smoking article includes a smokable material and a filter downstream of the smokable material. The filter comprises a capsule having a core and a breakable shell. The core has a mixture including one or more lipid compounds and one or more humectants. The lipid compounds account for 50% or more of the weight of the mixture. At least one of the one or more humectants is capable of interacting with one or more smoke constituents to reduce the concentration of the one or more smoke constituents in mainstream smoke.

14 Claims, 3 Drawing Sheets

(51) Int. Cl.
*A24B 15/30* (2006.01)
*A24B 15/40* (2006.01)
*A24D 3/02* (2006.01)

(58) Field of Classification Search
USPC ..... 131/35
See application file for complete search history.

(56) References Cited

U.S. PATENT DOCUMENTS

| | | | | |
|---|---|---|---|---|
| 8,470,215 | B2 * | 6/2013 | Zhang | A24B 15/283 264/4 |
| 2011/0232657 | A1 * | 9/2011 | Karles | A24B 15/186 131/275 |
| 2011/0277781 | A1 * | 11/2011 | Clark | A24D 3/04 131/280 |
| 2013/0081644 | A1 * | 4/2013 | Noda | A24D 3/04 131/337 |
| 2014/0123991 | A1 | 5/2014 | Fujita et al. | |
| 2018/0064161 | A1 * | 3/2018 | Kaihatsu | A24D 3/04 |

FOREIGN PATENT DOCUMENTS

| | | | |
|---|---|---|---|
| EA | 012456 | B1 | 10/2009 |
| EP | 0513603 | A1 | 11/1992 |
| EP | 1906775 | A2 | 4/2008 |
| EP | 2 745 717 | A1 | 6/2014 |
| EP | 2552255 | B1 | 1/2015 |
| JP | 2010-505423 | A | 2/2010 |
| JP | 2014-532435 | A | 12/2014 |
| WO | WO 02/21948 | A1 | 3/2002 |
| WO | WO 2006/117697 | A1 | 11/2006 |
| WO | WO 2006/136197 | A1 | 12/2006 |
| WO | WO 2007/010407 | A2 | 1/2007 |
| WO | WO 2008/067021 | A2 | 6/2008 |
| WO | WO 2010/146845 | A1 | 12/2010 |
| WO | WO 2011/117743 | A1 | 9/2011 |
| WO | WO 2012/156705 | A1 | 11/2012 |
| WO | WO 2013/068304 | A1 | 5/2013 |
| WO | WO 2013/187245 | A1 | 12/2013 |

OTHER PUBLICATIONS

Polyethylene Glycol, Sigma-Aldrich Inc., https://www.sigmaaldrich.com/content/dam/sigma-aldrich/docs/Sigma/Product_Information_Sheet/1/p4463pis.pdf (Year: 2019).*

Sorbitol, PubChem, National Center for Biotechnology Information, Department of Health and Human Services, https://pubchem.ncbi.nlm.nih.gov/compound/sorbitol (Year: 2019).*

Defintion of Humectant, The Merriam-Webster Dictionary, https://www.merriam-webster.com/dictionary/humectant (Year: 2020).*

International Search Report and Written Opinion, issued by the European Patent Office for PCT/IB2016/054844, dated Nov. 18, 2016; 12 pgs.

Written Opinion of the International Preliminary Examining Authority, issued by the European Patent Office for PCT/IB2016/054844, dated Jul. 12, 2017; 5 pgs.

International Preliminary Report on Patentability, issued by the European Patent Office for PCT/IB2016/054844, dated Nov. 15, 2017; 17 pgs.

European Search Report for EP 15181009.0, issued by the European Patent Office dated Mar. 2, 2016; 8 pgs.

Russian Decision to Grant and Search Report for RU Application 2018105058, issued by the Russian Patent Office dated Aug. 28, 2019; including English Translation: 16 pgs.

Chinese Office Action dated Jan. 17, 2020, issued by the China National Intellectual Property Office, for CN Application No. 201680042204.9, 15 pgs. including English Translation.

Japanese Office Action for JP Application No. 2018-503638, issued by the Japanese Patent Office dated Aug. 31, 2020; 6 pgs. including English Translation.

* cited by examiner

FLAVOR CAPSULES FOR SMOKING ARTICLES

This application is the § 371 U.S. National Stage of International Application No. PCT/IB2016/054844, filed 11 Aug. 2016, which claims the benefit of European Patent Application No. 15181009.0, filed 13 Aug. 2015.

FIELD

This disclosure relates to smoking articles having a filter that includes a breakable capsule containing one or more compounds that are capable of interacting with one or more smoke constituent to reduce the concentration of the smoke constituent in mainstream smoke.

BACKGROUND

Combustible smoking articles, such as cigarettes, typically have shredded tobacco (usually in cut filler form) surrounded by a paper wrapper forming a tobacco rod. A cigarette is employed by a smoker by lighting one end of the cigarette and burning the tobacco rod. The smoker then receives mainstream smoke by drawing on the opposite end or mouth end of the cigarette, which typically contains a filter. The filter is positioned to entrap some constituents of mainstream smoke before the mainstream smoke is delivered to a smoker.

Some smoke constituents, such as phenol or other phenolic compounds, can contribute to harsh taste and may not be effectively removed by the filter.

A variety of options exist for masking or removing harsh tasting smoke constituents. For example, smoking articles can include flavorants to mask harsh tastes of smoke or to modify the taste profile. Breakable capsules that release flavorants can be disposed in the filter. By way of another example, CN 103141939 A teaches that water and glycerol can trap phenol in smoke due to hydrogen bond interactions. CN 103141939 A discloses a smoking article having a capsule disposed in a filter. The capsule includes water and glycerol, which can be released when the capsule is crushed to capture, among other things, phenol. CN 103141939 does not disclose the use of hydrophobic substances in the core of the capsule.

However, capsules having humectants for removal of smoke constituents and having a majority of lipids in the core have not been suggested.

One object of the present invention is to provide smoking articles with a breakable capsule having contents capable of reducing the concentration of one or more constituents in mainstream smoke. Other objects of the present invention will be evident to those of skill in the art upon reading and understanding the present disclosure, which includes the claims that follow and accompanying drawings.

SUMMARY

In various aspects of the present invention, a smoking article includes a smokable material and a filter downstream of the smokable material. The filter comprises a capsule having a core and a breakable shell. The core has a mixture including one or more lipid compounds and one or more humectants. The lipid compounds account for 50% or more of the weight of the mixture. At least one of the one or more humectants is capable of interacting with one or more smoke constituents to reduce the concentration of the one or more smoke constituents in mainstream smoke.

As used herein, a "smokable material" is a material that generates an aerosol deliverable to a user of a smoking article when the material is placed in a smoking article and the smoking article is properly employed by a user. Preferably the smokable material comprises tobacco.

Various aspects of the smoking articles and methods of the present invention may have one or more advantages relative to currently available smoking articles that include humectants. For example, smoking articles containing capsules in accordance with various aspects of the present invention can provide, selective, on-demand, reduction of smoke constituents such as phenols or other phenolic compounds due to interaction with humectants released from the capsules. The reduction in selective smoke constituents can improve taste or reduce harshness of mainstream smoke. The humectants in the core can also serve to moisturize mainstream smoke upon breakage of the capsule. In addition, cores having high percentages of lipid components can advantageously be used as carriers for lipophilic flavorants. In addition, cores having a high proportion of lipid components can result in an emulsion with hydrophilic components, which emulsion can be encapsulated using seamless encapsulation methodologies. Accordingly, capsules can be formed that exhibit reduced leaking and associated spotting of the filter or filter sogginess. Additional advantages of one or more aspects of smoking articles described herein will be evident to those of skill in the art upon reading and understanding the present disclosure.

Any suitable breakable capsule may be employed in a smoking article as described herein. A breakable capsule includes a core containing a mixture of one or more humectants, one or more lipid compounds, and, optionally, one or more additional compounds. The core preferably consists essentially of, or consists of, the mixture.

Any suitable humectant can be included in the core. Examples of suitable humectants include sugar alcohols, sugar polyols, polymeric polyols, glycols, urea, and alpha-hydroxy acids. Examples of suitable humectant compounds include glycerol, glycerol triacetate, triethyl citrate, polyethylene glycol (PEG, such as $PEG_{400}$ and $PEG_{600}$), polyoxyethylene, maltitol, xylitol, sorbitol, propylene glycol, hexylene glycol, butylene glycol, triethylene glycol, and polydextrose. In some preferred embodiments, the core does not contain glycerol.

Preferably, one or more of the humectants in the core are hydrophilic, i.e., the humectant is a molecule that is at least partially polarized and capable of hydrogen bonding, enabling it to dissolve more readily in water than in oil. As used herein, "hydrophilic" means having a solubility in water of 25 grams or more per 100 milliliters at 25° C. Accordingly, "hydrophobic" means having a solubility in water of less than 25 grams per 100 milliliters at 25° C. In many cases, humectants have a solubility in water that is about 40 grams or more per 100 milliliters at 25° C., such as about 50 grams or more per 100 milliliters at 25° C. For example, the solubility of maltitol in water is about 200 g/100 ml; and the solubility of $PEG_{400}$ is about 44 grams/100 ml.

A humectant can interact with one or more smoke constituents in any suitable manner to reduce the concentration of the one or more constituents in mainstream smoke. For example, a humectant can react with a smoke constituent to form a new chemical compound, a humectant and a smoke constituent can interact through ionic bonding, or a humectant and a smoke constituent can interact through van der Waals forces. Preferably, a humectant and a smoke constituent interact through hydrogen bonding. Hydrogen bonding can occur through hydroxyl groups of phenols or other phenolic smoke constituents and oxygen-containing moieties, such as hydroxyl moieties of humectants if the humectant includes a hydroxyl group. Preferably, the humectant includes a hydroxyl group capable of interacting with a hydroxyl group of a phenolic smoke constituent. Examples of humectants having hydroxyl groups include sugar alcohols, sugar polyols, polymeric polyols, glycols. For example, glycerol, PEG, (such as $PEG_{400}$ and $PEG_{600}$), maltitol, xylitol, sorbitol, propylene glycol, hexylene glycol, butylene glycol, and triethylene glycol are humectants that contain hydroxyl moieties.

A humectant can be present in the core or in the mixture in any suitable concentration. For example, the cumulative concentration of the one or more humectants in the mixture can be in a range from about 1% to about 20%. Preferably, the cumulative concentration of the one or more humectants in the mixture is in a range from about 2% to about 15%. More preferably, the cumulative concentration of the one or more humectants in the mixture is in a range from about 7% to about 10%. Preferably, the mixture contains only one humectant.

Preferably, the mixture containing the one or more lipid compounds and the one or more humectants comprises an emulsion. One or more humectants can optionally be dissolved in an appropriate solvent prior to mixture with the one or more lipid compounds to favor formation of an emulsion. Similarly, the one or more lipid compounds can optionally be dissolved in an appropriate solvent prior to mixture with the one or more humectants.

The mixture of one or more lipid compounds and one or more humectants can include any suitable lipid compound. Lipid compounds are generally at least partially soluble in organic solvents such as chloroform and relatively insoluble in water. Lipids are hydrophobic compounds. Preferably, the one or more lipid compounds are aliphatic compounds or contain aliphatic moieties. More preferably, the one or more lipid compounds in the mixture of the core comprise, consist essentially of, or consist of, one or more triglycerides. Examples of suitable triglycerides include triglycerides of caprylic and capric acid, or mixtures of triglycerides such as coconut oil, vegetable oil, olive oil, sunflower oil, corn oil, groundnut oil, grape seed oil, wheat germ oil, mineral oils, silicone oils, or extracts thereof.

Preferably, the one or more triglycerides include one or more medium chain triglyceride. As used herein a "medium chain triglyceride" is a triglyceride in which at least two of the fatty acid moieties have a $C_6$-$C_{12}$ aliphatic tail. Preferably, all three of the fatty acid moieties have a $C_6$-$C_{12}$ aliphatic tail. Examples of medium chain fatty acids include hexanoic acid, octanoic acid, decanoic acid, and dodecanoic acid. Preferably, the one or more medium chain triglycerides account for 50% by weight to 100% by weight of the lipid compounds in the core. Preferably, the one or more medium chain triglycerides account for at least 60% by weight, at least 70% by weight, at least 80% by weight, at least 90% by weight. More preferably, the one or more medium chain triglycerides account for 90% by weight to 100% by weight of the lipid compounds in the core.

The one or more lipid compounds in the mixture account for 50% or more of the weight of the mixture. For example, the one or more lipid compounds in the mixture can be present in the mixture in a range from 50% weight to about 99% by weight. Preferably, the one or more lipid compounds account for 75% or more, more preferably 80% or more, of the weight of the mixture.

The mixture of the core can optionally contain one or more sensory enhancing agents. Any suitable sensory-enhancing agent may be included in the core of a breakable capsule. Suitable sensory-enhancing agents include flavorants and sensation agents. Suitable flavorants include aromatic or fragrance molecule as conventionally used in the formulation of flavoring or fragrance compositions. Preferably, the flavorant is an aromatic, terpenic or sesquiterpenic hydrocarbon. The flavorant may be an essential oil, alcohol, aldehyde, phenolic molecule, carboxylic acid in their various forms, aromatic acetal and ether, nitrogenous heterocycle, ketone, sulfide, disulfide and mercaptan which may be aromatic or non-aromatic. Examples of flavoring agents include natural or synthetic aromas or fragrances. Examples of suitable fragrances are fruity, confectionery, floral, sweet, woody fragrances. Examples of suitable aromas are coconut, vanilla, coffee, chocolate, cinnamon, mint, or roasted or toasted aromas. Suitable sensation agents include freshening agents, cooling agents, or hot effect agents, which respectively provide a freshening or cooling effect or a hot effect in the mouth. Suitable freshening agents may be, but are not limited to, menthyl succinate and derivatives thereof. A suitable hot effect agent may be, but is not limited to, vanillyl ethyl ether.

Other examples of suitable sensory enhancing agents include vanilla extract, honey, licorice extract, frambinone, 2-3 dimethyl pyrazine, ethyl butyrate, ethyl maltol, ethyl propionate, vanillin, furaneol, isobutyraldehyde, isovaleric acid, maltol, benzaldehyde, dimethyl sulphide, 2 methyl butyric acid, isovaleraldehyde, phenethyl alcohol, phenylacetic acid, heliotropine, valeric acid, valeraldehyde, butyl alcohol, butyric acid, benzyl alcohol, ethyl acetate, fenugreek extract, isobutyl alcohol, isobutyric acid, cyclotene, coffee dione, acetoin, sucrose, sorbitol, ethyl lactate, citric acid, chicory extract, alpha ionone, lactic acid, pyruvic acid, and vanilla oleoresin.

Preferably, the one or more sensory-enhancing agent comprises one or more flavorant that results in smoother taste of smoke. Examples of such compounds include acetoin, sucrose, sorbitol, ethyl lactate, lactic acid, vanilla oleoresin, benzyl alcohol, ethyl maltol, vanillin, furaneol, maltol, benzaldehyde, and heliotropine.

The sensory-enhancing agent can be hydrophilic or hydrophobic. Examples of some sensory-enhancing agents and their solubility in water are shown in Table 1 below.

TABLE 1

Solubility of some sensory-enhancing agents in water

| High solubility in water (>1 kg/L) | Medium solubility in water (40 to 300 g/L) | Low solubility in water (5 to 40 g/L) |
|---|---|---|
| Acetoin | Butyl alcohol | Frambinone |
| Sucrose | Butyric acid | 2-3 dimethyl pyrazine |
| Sorbitol | Benzyl alcohol | Ethyl butyrate |
| Ethyl lactate | Ethyl acetate | Ethyl maltol |
| Citric acid | Fenugreek extract | Ethyl propionate |
| Chicory extract | Isobutyl alcohol | Vanillin |
| Alpha ionone | Isobutyric acid | Furaneol |
| Lactic acid | Cyclotene | Isobutyraldehyde |
| Pyruvic acid | Coffee dione | Isovaleric acid |
| *Vanilla* oleoresin | | Maltol |
| | | Benzaldehyde |
| | | Dimethyl sulphide |
| | | 2 methyl butyric acid |
| | | Isovaleraldehyde |
| | | Phenethyl alcohol |
| | | Phenylacetic acid |
| | | Heliotropine |

TABLE 1-continued

| Solubility of some sensory-enhancing agents in water | | |
|---|---|---|
| High solubility in water (>1 kg/L) | Medium solubility in water (40 to 300 g/L) | Low solubility in water (5 to 40 g/L) |
| | | Valeric acid valeraldehyde |

Those sensory-enhancing agents having limited low or medium solubility in water may benefit from high concentrations of lipid compounds in the mixture of the core, as they may be more soluble in the lipid component. Those sensory-enhancing agents having high solubility in water will likely be present in the hydrophilic portion of the core, such as with hydrophilic humectants.

The concentration of sensory-enhancing agent in a breakable capsule can be adjusted or modified to provide a desired amount of the sensory-enhancing agent. Thus, the concentration of sensory-enhancing agent within each capsule can be the same or can vary depending on the desired sensory result.

A smoking article of the present invention can include any suitable breakable suitable shell. For example, the shell of a breakable capsule can include one or more hydrocolloids, which can be, for example, gelatin or a vegetable ingredient. For example, the shell can include gelatin; a modified starch; a polysaccharide based material, such as pectin or alginate; gelatin; a paraffin wax; a polyvinyl alcohol; vinyl acetate; agar; algin; sorbitol; glycerol; arabic guar; carrageenan; a vegetable gum such as ghatti gum, pullulan gum, mannan gum; or any other suitable material or combinations thereof. Preferably, the shell contains an alginate.

The shell may contain any suitable amount of the one or more hydrocolloids, such as from about 1.5% w/w to about 95% w/w, preferably from about 4% w/w to about 75% w/w, and even more preferably from about 20% w/w to about 50% w/w of the total dry weight of the shell.

The shell may further include one or more fillers. As used herein a "filler" is any suitable material that can increase or decrease the percentage of dry material in the shell, or change the viscoelastic properties of the shell (such as a plasticizer). Increasing the dry material amount in a shell can result in solidifying the shell, and in making the shell physically more resistant to deformation. Preferably, the filler is selected from the group comprising starch derivatives such as dextrin, maltodextrin, cyclodextrin (alpha, beta or gamma), or cellulose derivatives such as hydroxypropylmethylcellulose (HPMC), hydroxypropylcellulose (HPC), methylcellulose (MC), carboxymethylcellulose (CMC), polyvinyl alcohol, polyols or mixture thereof. Dextrin is a preferred filler. The amount of filler in the shell is generally 98.5% or less, preferably from about 25% to about 95%, more preferably from about 40% to about 80%, and even more preferably from about 50% to about 60% by weight of the total dry weight of the shell.

In some preferred embodiments, the shell includes one or more humectant. The one or more humectants can account for any suitable weight percentage of the shell. In particularly preferred embodiments, the shell includes an alginate and a humectant.

The shell of a crushable capsule may be of any suitable thickness. In some embodiments, the shell thickness of the capsule is from about 10 microns to about 500 microns, preferably from about 20 microns to about 150 microns, more preferably from about 30 microns to about 80 microns.

A capsule for incorporation into a smoking article in accordance with the teachings presented herein may have any suitable ratio of the weight of the shell to the weight of the capsule. For example, the ratio of the weight of the shell to the weight of the capsule can be from about 5% to about 15%, preferably from about 6% to about 10%, more preferably from about 8% by weight/total weight of the capsule.

The core may represent any suitable weight percent of the capsule. For example, the core of a breakable capsule represents by weight from about 85% to about 95% of the capsule, preferably from about 90% to about 94% by weight, more preferably from about 92% by weight.

A capsule may have any suitable total weight. The total weight of the capsule can be from about 5 mg to about 60 mg, preferably from about 10 mg to about 50 mg, more preferably from about 15 mg to about 40 mg. For example, a capsule with a diameter of 3.5 mm may weigh 22 mg and a capsule of diameter of 3.0 mm may weigh 17 mg.

A capsule for incorporation into a smoking article in accordance with the teachings presented herein may have any suitable outer diametric dimension. In some embodiments, the outer diameter of the capsule is in the range of about 2 mm to about 7 mm, preferably from about 3 mm to about 6 mm, more preferably from about 4 mm to about 5 mm.

It can be appreciated that a multitude of processes exist for manufacturing breakable capsules. Accordingly, the capsules can be of varying size and shape, differing resistance to kinetic or thermal forces to break or rupture the capsule, and can include alternative capsule compositions and capsule constituents.

In some embodiments, a capsule for use in a smoking article of the invention is a seamless capsule obtained through a co-extrusion process. The co-extrusion process can be a synchronous extrusion of two liquids: an external and hydrophilic liquid phase, and an internal and lipophilic liquid phase. Preferably, the co-extrusion process includes three main stages: compound drop formation, shell solidification and capsule collection. The compound drop is a sphere of the liquid fill phase inside the shell phase. The liquid fill phase constitutes the core. The shell phase constitutes the shell. The capsules of the invention may be produced by any suitable co-extrusion process, such as described in EP1906775A2 or EP 513603.

In some embodiments, the capsules can be formed by any methods known in the art that comprise dripping of a core emulsion and a shell solution into gelation bath, such as but not limited to, simple dripping, drip casting, electrostatic dripping, coaxial air flow technique, liquid-jet breakup technique, vibrating jet (nozzle) breakup technique, jet cutting technique, and rotating (or spinning) disk atomization. It has been found that the use of high weight percent glycerin as the shell component results in a stable emulsion with the core emulsion and thus does not result in effective crushable capsules. However, when the shell solution comprises alginate a non-stable emulsion is formed and crushable capsules having a fluid core and a breakable shell result. It is believed that some of the humectant migrates to the shell during such processes.

Preferably, the breakable capsules are crushable capsules. As used herein, a crushable capsule is a capsule having a crush strength from about 0.01 kp to about 5 kp, preferably from about 0.5 kp to about 2.5 kp. The crush strength of the capsule can be measured by continuously applying a load vertically onto one capsule until rupture. The crush strength of the capsules can be measured by using a LLOYD-CHATILLON Digital Force Gauge, Model DFIS 50, having a capacity of 25 Kg, a resolution of 0.02 Kg, and an accuracy of +/−0.15%. The force gauge can be attached to a stand; the capsule can be positioned in the middle of a plate that is moved up with a manual thread screw device. Pressure can then be applied manually. The gauge records the maximum force applied at the very moment of the rupture of the capsule (measured in, for example, Kg or in Lb). Rupture of the capsule results in the release of contents of the core.

Additional methods for characterizing capsules include crush force which is the maximum compressive force measured in, for example, Newtons that a capsule can withstand before breakage; and distance at breakage which is the change in dimension of the capsule due to compression, i.e., deformation, at breakage. It can also be expressed for example by the ratio between a dimension of the capsule (e.g., the capsule diameter) and the dimension of the capsule, measured in the direction of the compression force, when it is compressed to the point of breakage. The compression is generally applied toward the floor by the compression plates of an automatic or manual compression testing machine. Such machines are well known in the art and commercially available.

In preferred embodiments, the capsule has a crush strength prior to introduction into a smoking article of from about 0.6 kp to about 2 kp, preferably from about 0.8 kp to about 1.2 kp. The capsule preferably has a crush strength after introduction into a smoking article and subjected to a smoking test from about 0.6 kp to about 2 kp, more preferably from about 0.8 kp to about 1.2 kp. Alternatively, the capsule has a crush force value prior to introduction into a smoking article of about 5 N to about 20 N, preferably from about 7 N to about 18 N, and more preferably about 12.0 N. The compression test machine can operate at a range of speed from 10 mm/min to 420 mm/min. For capsules of diameter in the range of about 4 mm to about 7 mm diameter, the capsule prior to introduction into a smoking article may exhibit a distance at breakage of about 0.60 mm to about 0.80 mm, preferably about 0.74 mm. The above crush force and distance at breakage is typically obtained when a universal tensile/compression testing machine equipped with 100 N tension load cell like, Instron or equivalent, is operating at about 30 mm/min and at 22° C. under 60% relative humidity. An example of a manual test machine is the Alluris Type FMI-220$C_2$-Digital Force Gauge 0-200N-Supplier: Alluris GmbH & Co.

Preferably, the distance at breakage is in a range from about 0.5 mm to about 2 mm; more preferably from about 1 mm to about 1.5 mm; and even more preferably about 1.25 mm.

A crushable capsule of the present invention can be placed in a smoking article downstream of a smokable material in any suitable manner. The term "downstream" refers to relative positions of elements of the smoking article described in relation to the direction of mainstream smoke as it is drawn from a smokable material and into a user's mouth. Preferably, the crushable capsule is placed in a filter element.

A crushable capsule can be placed within a void or cavity in the filter. For example, the crushable capsule may be placed in a cavity in a plug-space-plug configuration. The filter may contain a plurality of filter elements into which crushable capsules may be placed.

Preferably, the crushable capsule is embedded in filter material, such as cellulose acetate tow, polylactic acid (PLA), or paper. For example, the filter can be embedded in a filter material in a manner similar to how flavor-containing breakable capsules are incorporated into filters of cigarettes.

The term "smoking article" includes cigarettes, cigars, cigarillos and other articles in which a smokable material, such as a tobacco, is lit and combusted to produce smoke. The term "smoking article" also includes articles in which smokable material is not combusted, such as but not limited to smoking articles that heat a smoking composition directly or indirectly, or smoking articles that use air flow or a chemical reaction, with or without a heat source, to deliver nicotine or other materials from the smokable material.

As used herein, the term "smoke" is used to describe an aerosol produced by a smoking article. An aerosol produced by a smoking article may be, for example, smoke produced by combustible smoking articles, such as cigarettes, or aerosols produced by non-combustible smoking articles, such as heated smoking articles or non-heated smoking articles.

All scientific and technical terms used herein have meanings commonly used in the art unless otherwise specified. The definitions provided herein are to facilitate understanding of certain terms used frequently herein.

As used herein, the singular forms "a", "an", and "the" encompass embodiments having plural referents, unless the content clearly dictates otherwise.

As used herein, "or" is generally employed in its sense including "and/or" unless the content clearly dictates otherwise. The term "and/or" means one or all of the listed elements or a combination of any two or more of the listed elements.

As used herein, "have", "having", "include", "including", "comprise", "comprising" or the like are used in their open ended sense, and generally mean "including, but not limited to". It will be understood that "consisting essentially of", "consisting of", and the like are subsumed in "comprising," and the like.

The words "preferred" and "preferably" refer to embodiments of the invention that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the disclosure, including the claims.

DETAILED DESCRIPTION

Figure 1:
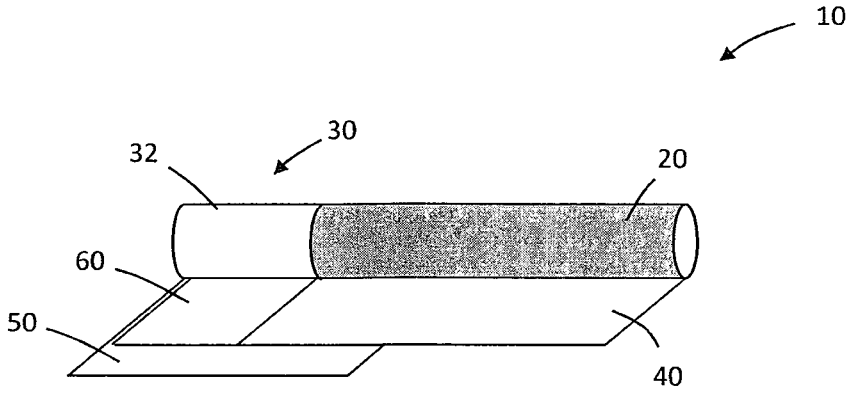
FIG. 1 is a schematic perspective view of an embodiment of a partially unrolled smoking article.

Referring now to FIG. 1, a smoking article 10, in this case a cigarette, is depicted. The smoking article 10 includes a rod 20, such as a tobacco rod, and a mouth end filter 30 that includes filter material 32, such as cellulose acetate tow. The depicted smoking article 10 includes plug wrap 60, cigarette paper 40, and tipping paper 50. In the depicted embodiment, the plug wrap 60 circumscribes at least a portion of the filter 30. The cigarette paper 40 circumscribes at least a portion of the rod 20. Tipping paper 50 or other suitable wrapper circumscribes the plug wrap 60 and a portion of the cigarette paper 40 as is generally known in the art. The filter 30 includes a crushable capsule, which may be oriented as depicted in, for example, FIG. 2 and FIG. 3.

Figure 2:
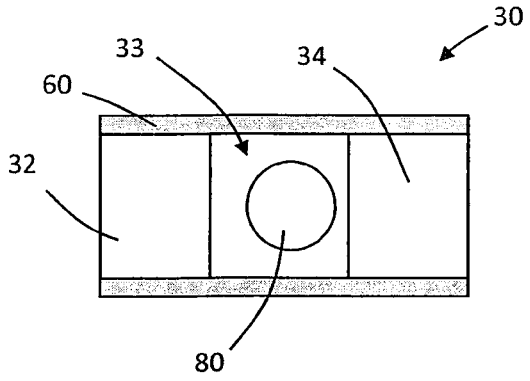
FIGS. 2-3 are schematic longitudinal sectional views of embodiments of filters including a capsule.

FIG. 2 illustrates an embodiment where filter 30 is in a plug 32-space 33-plug 34 configuration, circumscribed by plug wrap 60. Plug 32 is the mouth end plug and is preferably white cellulose acetate tow. Crushable capsule 80 is disposed in void space 33 between plugs 32 and 34.

Figure 3:
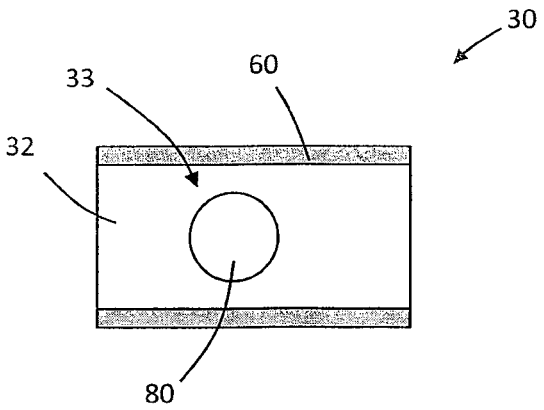

FIG. 3 illustrates an embodiment where filter 30 crushable capsule 80 is embedded in filter material 32, circumscribed by plug wrap 60.

Figure 4:
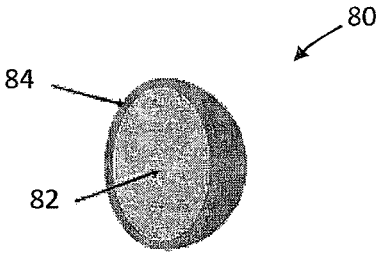
FIG. 4 is a schematic perspective view of a cross section of a capsule.

FIG. 4 illustrates an embodiment of a crushable capsule 80 that includes a core 82 surrounded by a breakable shell 84.

In the following non-limiting examples that provide illustrative embodiments of the capsules and methods described above. These examples are not intended to provide any limitation on the scope of the disclosure presented herein.

EXAMPLES

To determine whether humectants in filters can effectively remove phenol from mainstream smoke, filters of cigarettes were injected with a composition comprising a humectant. Various humectants were evaluated at various concentrations. Table 2 below illustrates volumes, densities, and concentrations of humectant compositions injected into the filters.

TABLE 2

Humectant compositions injected into filters for testing phenol reduction

| | Humectant | Density [20° C.] | Concentration [% w/w] | Injected Volume in filters [μl] |
|---|---|---|---|---|
| Prototype A | Triethyl citrate | 1.140 | 7 | 8.3 |
| Prototype B | Triethyl citrate | 1.140 | 10 | 11.9 |
| Prototype C | ethyleneglycol | 0.98 | 7 | 9.7 |
| Prototype D | ethyleneglycol | 0.98 | 10 | 13.8 |
| Prototype E | PEG 600 | 1.126 | 7 | 8.4 |
| Prototype F | PEG 600 | 1.126 | 10 | 12.0 |

Humectants were dissolved in ethanol to the desired concentration, and then the dissolved humectant compositions were injected into filters.

The ability of the humectant compositions to reduce phenol concentrations in mainstream smoke was tested as follows. Briefly, cigarette mainstream smoke was collected according to ISO 3308 under standard conditions onto a Cambridge filter pad. The filter pad is extracted with an organic solvent, and the extract was subjected to analysis by routine gas chromatography/mass spectroscopy.

Figure 5:
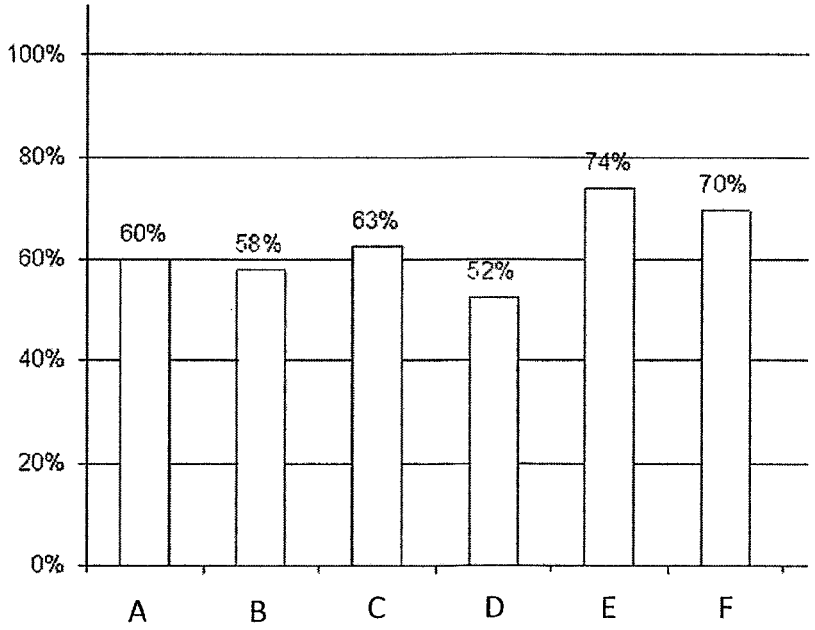
FIG. 5 is a plot of percentages of yields of phenol relative to control cigarettes in which no humectant was injected. The smoking articles, filters, and capsules depicted in FIGS. 1-4 illustrate embodiments of smoking articles or components of smoking articles described above. The schematic drawings are not necessarily to scale and are presented for purposes of illustration and not limitation. The drawings depict one or more aspects described in this disclosure. However, it will be understood that other aspects not depicted in the drawings fall within the scope and spirit of this disclosure.

The results of the testing are presented in FIG. 5, with the percentages of yields in phenol relative to the yields of phenol in control cigarettes into which no humectant was injected. These results show that the humectants are effective in significantly reducing the level of a smoke constituent from mainstream smoke.

A number of breakable capsules were prepared and characterized. Table 3 below lists the ingredients used to form three batches of capsules.

TABLE 3

Ingredients used to produce capsules

| | 001 | | 002 | | 003 | |
|---|---|---|---|---|---|---|
| Ingredient | mg | % | mg | % | mg | % |
| MCT | 32.94 | 90.00 | 35.55 | 90.00 | 31.32 | 90.00 |
| $CaCl_2$ | 1.52 | 4.15 | 1.50 | 3.80 | 1.50 | 4.31 |
| PVA | 0.50 | 1.37 | 0.50 | 1.27 | 0.50 | 1.44 |
| Alginate | 0.70 | 1.91 | 0.70 | 1.77 | 0.70 | 2.01 |
| Propylene glycol | 0.94 | 2.57 | 1.25 | 3.16 | 0.78 | 2.2 |
| TOTAL | 36.6 | 100.0 | 39.5 | 100.0 | 34.8 | 100.0 |

MCT = medium chain triglyceride.
PVA = polyvinyl alcohol.

Capsules for batches 001, 002 and 003 were prepared by a vibration het breakup technique.

As indicated in Table 3, the shell ($CaCl_2$), PVA and alginate) was about 7% to about 8% of the weight of the capsule, while the core (MCT and propylene glycol) was about 92% to about 93% of the weight of the capsule.

The average diameter of the capsules for batch 001 was 4.3 mm. The average diameter for the capsules for batch 002 was 4.2 mm. The average diameter for the capsules for batch 003 was 4.2 mm.

Capsules from batch 1 were subjected to breakage testing as described above in the specification. Crush force and distance at breakage were evaluated. The mean crush force was 11.9 N, and the mean distance at break was 1.25 mm.

Thus, methods, systems, devices, compounds and compositions for FLAVOR CAPSULES FOR SMOKING ARTICLES are described. Various modifications and variations of the invention will be apparent to those skilled in the art without departing from the scope and spirit of the invention. Although the invention has been described in connection with specific preferred embodiments, it should be understood that the invention as claimed should not be unduly limited to such specific embodiments. Indeed, various modifications of the described modes for carrying out the invention which are apparent to those skilled in chemistry; chemical engineering; filter manufacturing; cigarette manufacturing; or related fields are intended to be within the scope of the following claims.

The invention claimed is:

1. A smoking article comprising:

a smokable material; and a filter downstream of the smokable material, wherein the filter comprises a seamless crushable capsule comprising a core and a breakable shell surrounding the core, wherein the core comprises a mixture including one or more lipid compounds, and one or more humectants that are capable of interacting with one or more smoke constituents to reduce the concentration of the one or more smoke constituents in mainstream smoke, and wherein the one or more lipid compounds account for 50% or more of the weight of the mixture, and wherein the one or more humectants account for 2% to 15% of the weight of the mixture.

2. The smoking article of claim 1, wherein the one or more lipid compounds comprise one or more medium chain triglycerides.

3. The smoking article of claim 2, wherein the one or more medium chain triglycerides account for 50% or more of the weight of the mixture.

4. The smoking article of claim 2, wherein at least one of the one or more medium chain triglycerides is a medium chain triglyceride that is present in coconut oil.

5. The smoking article of claim 1, wherein at least one of the one or more humectants is hydrophilic and comprises a sugar alcohol, a sugar polyol, a polymeric polyol, or a glycol capable of forming a hydrogen bond with phenol.

6. The smoking article of claim 1, wherein the one or more humectants comprise a compound selected from the group consisting of glycerol triacetate, triethyl citrate, ethylene glycol, polyethylene glycol, and polyoxyethylene.

7. The smoking article of claim 1, wherein the one or more humectants comprise polyethylene glycol 400 or polyethylene glycol 600.

8. The smoking article of claim 1, wherein the mixture is an emulsion.

9. The smoking article of claim 1, wherein the capsule is formed via a vibration jet breakup technique.

10. The smoking article of claim 1, wherein the capsule has a diameter in a range from 3 mm to 5 mm.

11. The smoking article of claim 1, wherein the capsule has a crush force value prior to introduction into the smoking article of from 5 N to 20 N.

12. The smoking article of claim 1, wherein the core further comprises a flavorant.

13. The smoking article of claim 12, wherein the flavorant is selected from the group consisting of acetoin, sucrose, sorbitol, ethyl lactate, lactic acid, vanilla oleoresin, benzyl alcohol, ethyl maltol, vanillin, furaneol, maltol, benzaldehyde, and heliotropine.

14. The smoking article of claim 12, wherein the flavorant is hydrophilic.

* * * * *